US007309101B2

(12) United States Patent
True

(10) Patent No.: US 7,309,101 B2
(45) Date of Patent: Dec. 18, 2007

(54) FOLDING OTTOMAN

(75) Inventor: Alan L. True, San Juan Capistrano, CA (US)

(73) Assignee: True Seating Concepts, LLC (MU)

( * ) Notice: Subject to any disclaimer, the term of this patent is extended or adjusted under 35 U.S.C. 154(b) by 81 days.

(21) Appl. No.: 11/386,272

(22) Filed: Mar. 21, 2006

(65) Prior Publication Data

US 2007/0222261 A1 Sep. 27, 2007

(51) Int. Cl.
*A47C 13/00* (2006.01)
*A47C 7/62* (2006.01)
*A47C 16/00* (2006.01)

(52) U.S. Cl. ..... 297/118; 297/378.1; 297/188.11; 297/423.41

(58) Field of Classification Search ..... 297/128, 297/378.1, 188.11, 378.12, 127, 118, 423.41
See application file for complete search history.

(56) References Cited

U.S. PATENT DOCUMENTS

| | | | | | |
|---|---|---|---|---|---|
| 794,461 | A * | 7/1905 | Mackey | 297/134 |
| 811,475 | A * | 1/1906 | Bradley | 190/8 |
| 1,207,510 | A * | 12/1916 | Decker | 297/128 |
| 2,217,426 | A * | 10/1940 | Zareko | 297/117 |
| 2,655,203 | A * | 10/1953 | Wegner | 297/105 |
| 2,692,639 | A * | 10/1954 | Genovese | 297/105 |
| 2,693,846 | A * | 11/1954 | Luttio | 297/105 |
| 2,705,994 | A * | 4/1955 | Stattler | 297/105 |
| 2,716,775 | A * | 9/1955 | Kenimer | 16/357 |
| 3,655,242 | A * | 4/1972 | Ghyczy | 297/451.11 |
| 4,527,830 | A * | 7/1985 | Meyers | 297/188.09 |
| 5,094,505 | A * | 3/1992 | Nichols | 297/118 |
| 5,520,436 | A * | 5/1996 | Rader et al. | 297/188.11 |
| 6,588,837 | B1 * | 7/2003 | Schultz et al. | 297/111 |
| 2005/0023869 | A1 * | 2/2005 | Longnecker | 297/125 |

* cited by examiner

*Primary Examiner*—Milton Nelson, Jr.
(74) *Attorney, Agent, or Firm*—Morland C. Fischer

(57) ABSTRACT

Disclosed herein is a folding ottoman which is convertible to a chair having the usual seat and back rest. A seat frame extends between a pair of opposing arm panels. A storage compartment is slidably connected to the arm panels below the seat frame. The storage compartment is adapted to slide outwardly relative to the seat frame in response to a pulling force applied thereto so as to enable a user to gain access to a storage space at the interior of the storage compartment. A flip-up back rest is pivotally connected to the pair of arm panels by way of a pair of machine bolts extending therebetween. The back rest is rotatable relative to the seat frame from a horizontal, closed position lying atop the seat frame at which the ottoman is established to a vertical, open position standing upwardly from the seat frame at which the chair is established.

11 Claims, 3 Drawing Sheets

FOLDING OTTOMAN

BACKGROUND OF THE INVENTION

1. Field of the Invention

This invention relates to a folding ottoman that is convertible to a chair. A flip-up back rest is rotatable from a closed, horizontal position at which to establish the ottoman to an open, vertical position at which to establish the chair having the usual seat and back support.

2. Background Art

For those living in a small apartment or those having a room in a home or office where space is minimal, it is not always possible to furnish such apartment or room with many different pieces of furniture. To overcome this problem, folding furniture is known which is convertible from one structural configuration to another. By way of example, folding sofas which provide seating are known to be convertible to a bed for sleeping. By virtue of the foregoing, a user can gain the benefits of multiple functions from the same piece of furniture, but without having to own more than a single piece. Therefore, it would be advantageous for some apartment dwellers and home owners to have access to single pieces of space conserving furniture which can be folded or collapsed to establish different structural configurations having correspondingly different functions, but without the expense and requirement that individual pieces be purchased and used to perform the same functions.

SUMMARY OF THE INVENTION

In general terms, a folding ottoman is disclosed that is convertible into a comfortable, upholstered chair having the usual seat and back support. The ottoman includes a pair opposing arm panels that are spaced from one another. A seat frame extends between the pair of arm panels. A flip-up back rest is pivotally connected to the arm panels so as to be rotatable relative to the seat frame. More particularly, the flip-up back rest is rotatable from a closed, horizontal position lying atop the seat frame at which to establish the ottoman to an open, vertical position standing upwardly from the seat frame at which to function as a back support and thereby establish the chair. Each of the seat frame and back rest are hollow so as to be filled (i.e., stuffed) with a cushion material. A pull-out drawer having a storage space at the interior thereof is located below the seat frame. The pull-out drawer is slidably connected to the opposing arm panels so as to slide outwardly relative to the seat frame to permit access to the storage space at the interior thereof in response to a pulling force applied thereto.

A curved slot is formed in each of the side panels. An arm panel bracket having a corresponding curved slot formed therein is affixed between each side panel and an oppositely aligned side of the flip-up back rest. A pair of threaded bolts are received through the curved slots of the arm panel brackets and the side panels by which the back rest is pivotally coupled to and between the side panels. One of the bolts functions as a pivot pin to ride through the curved slots when the flip-up back rest is rotated between the closed, horizontal position atop the seat frame to the open, vertical position standing upwardly from the seat frame. The second of the pair of bolts rides through and to the end of the slots to create a stop so as to limit the rotation of the flip-up back rest in the open, vertical position.

DESCRIPTION OF THE PREFERRED EMBODIMENT

Figure 2:
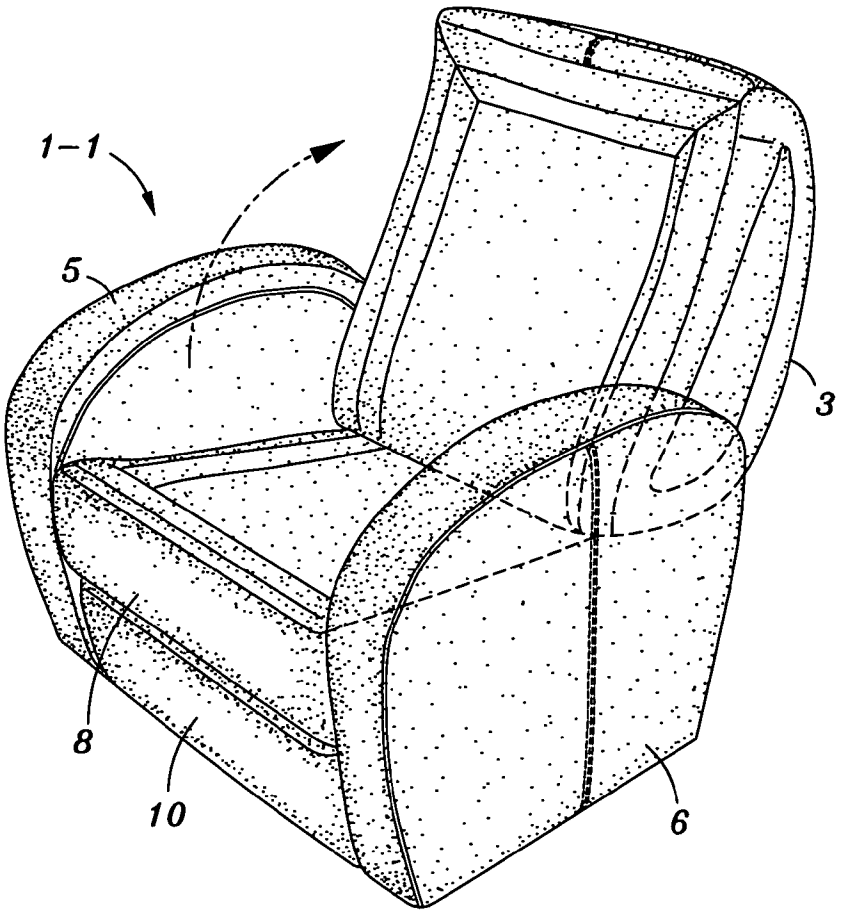
FIG. 2 shows a flip-up back rest of the ottoman of FIG. 1 rotated to an open, vertical position at which to establish a chair.

Referring initially to FIGS. 1-4 of the drawings, there is shown a folding ottoman (of FIGS. 1 and 3) according to a preferred embodiment that is convertible into a chair 1-1 (of FIGS. 2 and 4) of the kind that is typically used in an apartment, home or office and on which a user is seated while relaxing or watching television. The ottoman 1 includes a flip-up back rest 3 which is pivotally connected to a pair of opposing arm panels 5 and 6 that are spaced from one another. That is, the flip-up back rest 3 is rotatable from a closed position (of FIGS. 1 and 3) where the ottoman 1 is established to an open position (of FIGS. 2 and 4) where the chair 1-1 is established. In the closed position, the back rest 3 extends horizontally between the pair of side panels 5 and 6 to provide a flat footrest or a sitting surface in the manner of a conventional ottoman. In the open (i.e., flipped-up) position, the back rest 3 projects upwardly and vertically from behind the side panels 5 and 6 to provide a back support in the manner of a conventional chair.

The folding ottoman 1 also includes a seat frame 8 over which the flip-up back rest 3 is rotated in the closed position to establish the ottoman 1 and support the legs of a user. With the flip-up back rest 3 rotated to the open position to establish the chair 1-1, the seat frame 8 will support the weight of the user. The manner in which the flip-up back rest 3 is pivotally connected to the opposing arm panels 5 and 6 so as to be rotatable relative to the seat frame 8 between the closed and open positions will be described in greater detail when referring hereinafter to FIG. 5.

Located below the seat frame 8 is a hollow storage compartment 10. In accordance with a preferred embodiment, and as will also be described when referring to FIG. 5, the storage compartment 10 is slidably connected to and between the opposing arm panels 5 and 6. In this manner, the storage compartment 10 can be pulled outwardly relative to the seat frame 8 to provide access to a storage space at the interior thereof at which various articles can be stored so as to be readily available to the user regardless of the position of the flip-up back rest 3 and whether the ottoman 1 or the chair 1-1 has been established.

Figure 1:
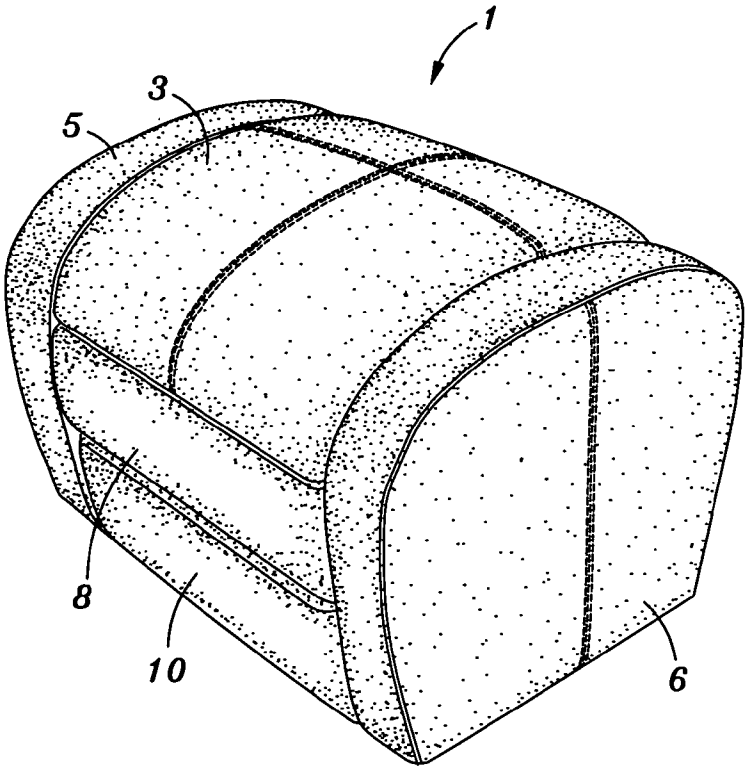
FIG. 1 is a perspective view showing a folding ottoman according to a preferred embodiment of this invention in a folded configuration.

Each of the flip-up back rest 3, the opposing arm panels 5 and 6, the seat frame 8, and the pull-out storage compartment 10 of the ottoman/chair 1 and 1-1 shown in FIGS. 1-4 is manufactured from plywood, hardwood, metal, or any other suitable material. Moreover, and as illustrated in FIGS. 1 and 2, the back rest 3, arm panels 5 and 6, seat frame 8, and storage compartment 10 are shown suitably cushioned and upholstered so that a comfortable and ornamentally stylish piece of furniture is available for use in a household or office as either a flat ottoman 1 or a chair 1-1 having the usual seat and upstanding back rest.

Figure 4:
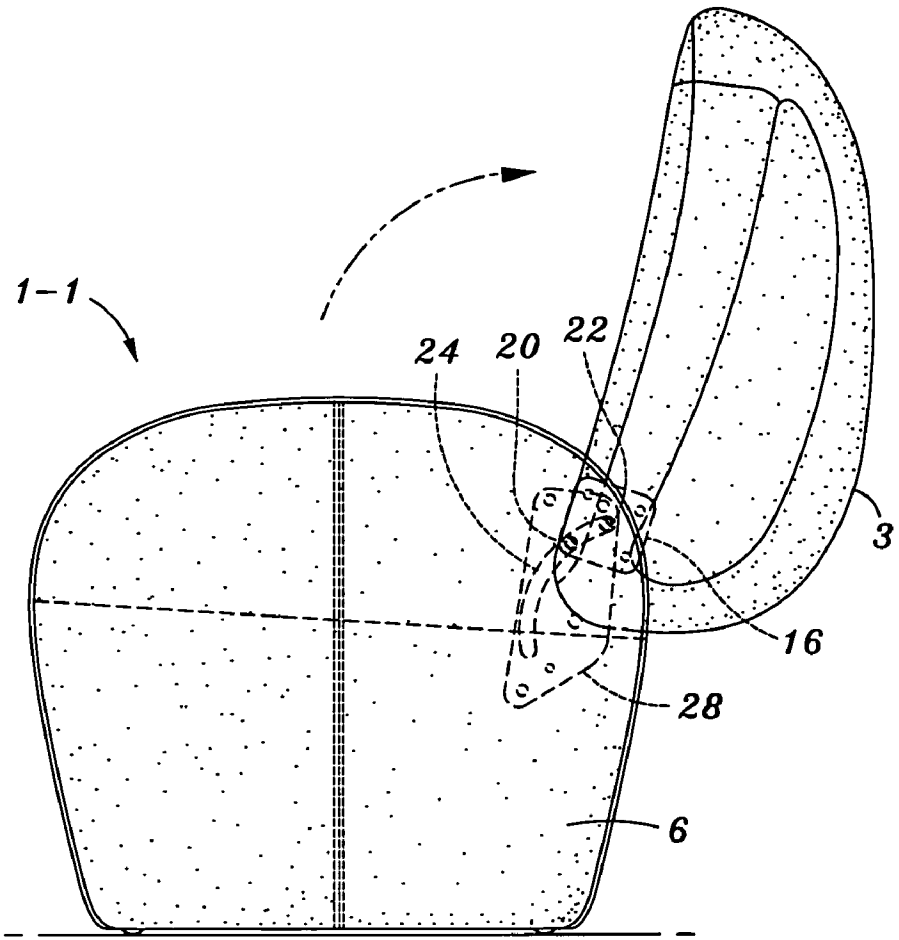
FIG. 4 shows the flip-up back rest pivotally coupled to the opposing side panels of the ottoman when the back rest is rotated to the open, vertical position.
Figure 3:
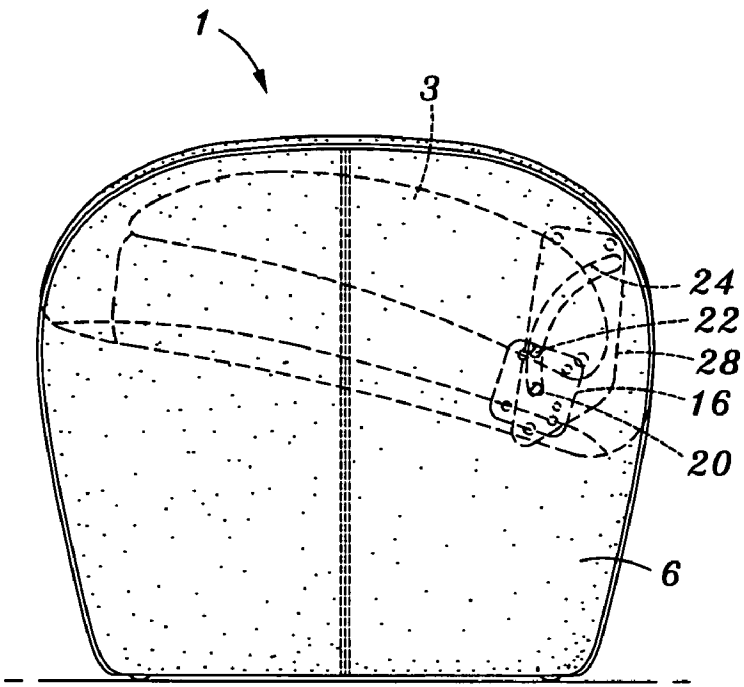
FIG. 3 shows the flip-up back rest pivotally coupled to opposing side panels of the ottoman when the back rest is rotated to a closed, horizontal position.
Figure 5:
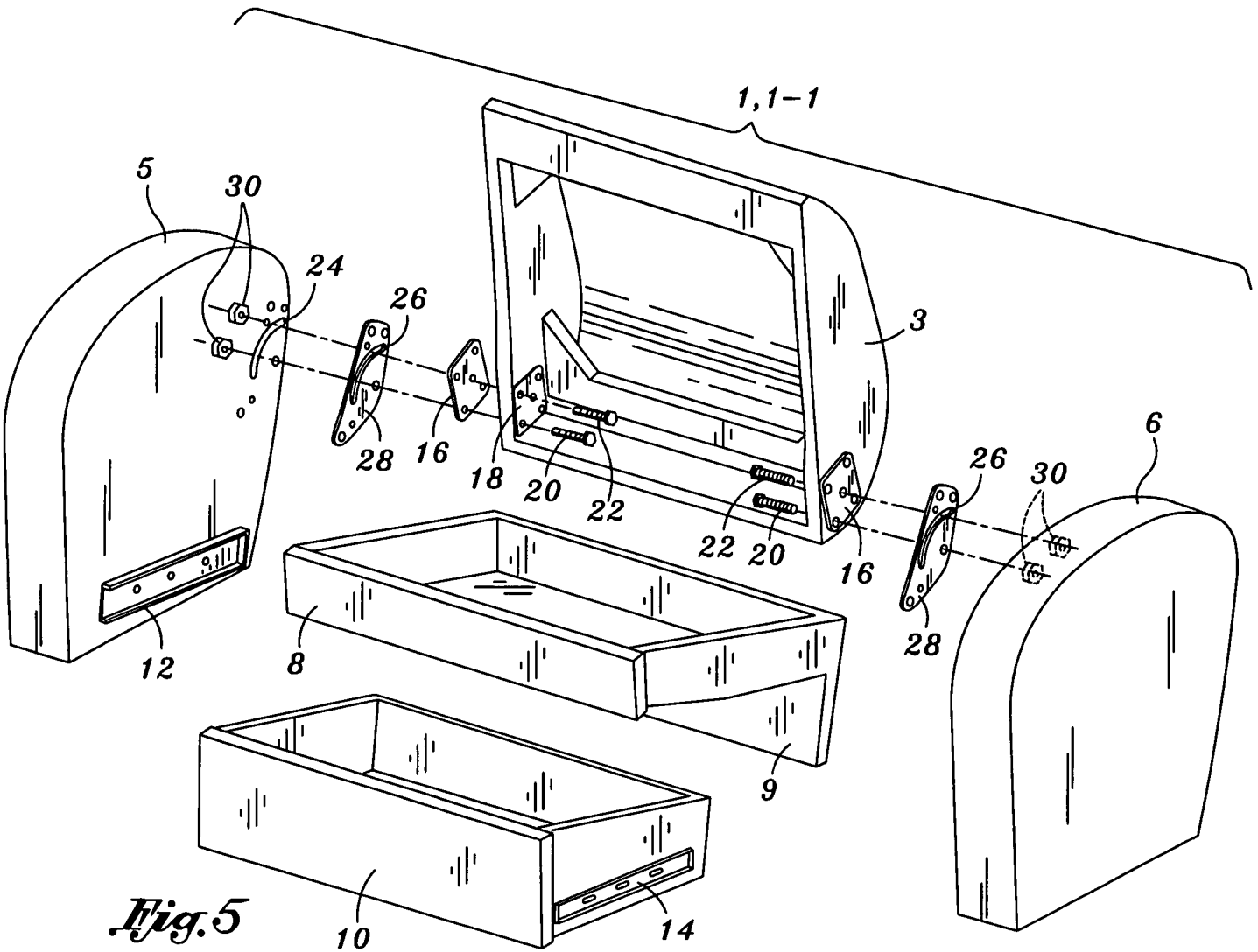
FIG. 5 is an exploded view of the folding ottoman showing details of the pivotal connection of the flip-up back rest to the opposing side panels so as to be rotatable between the closed and open positions.

Turning now to FIG. 5 of the drawings, the assembly details are described by which the folding ottoman 1 shown in FIGS. 1 and 3 can be easily converted to the chair 1-1 of FIGS. 2 and 4 having a comfortable seat and back rest. The seat frame 8 is affixed to (by means of wood screws, adhesive, or the like) and extends between the opposing arm panels 5 and 6 so as to lie between the flip-up back rest 3 at the top of the ottoman 1 and the storage compartment 10 at the bottom of the ottoman 1. The seat frame 8 has a hollow interior so as to be filled with a suitable cushion material (not shown) prior to being upholstered so as to support the weight of the user or his legs depending upon whether the ottoman 1 or the chair 1-1 has been established. An extension 9 of the back wall depends downwardly from the seat frame 8 to engage the back end of the storage compartment 10 so that the seat frame 8 and the storage compartment 10 will be aligned one above the other.

An outer slide guide (only one of which 12 being shown) is affixed inside each of the opposing arm panels 5 and 6 of the folding ottoman 1. A corresponding inner slide (only one of which 14 being shown) is affixed, in opposing alignment with the outer slide guides 12, to opposite sides of the storage compartment 10. In the assembled configuration of FIGS. 1-4, the inner slides 14 of storage compartment 10 are slidably received within the outer slide guides 12 of arm panels 5 and 6 so that the storage compartment 10 can move (i.e., slide outwardly and inwardly) relative to the seat frame 8 in response to a pulling or pushing force applied thereto when it is desirable to gain access to the storage space at the interior of compartment 10. Despite the pull-out nature thereof, it is within the scope of the present invention for the storage compartment 10 to have a rotating, drop-down front (not shown) by which to enable the user to also gain access to the storage area at the interior of compartment 10.

The flip-up back rest 3 is preferably a hollow, shell-like support member that can be filled (i.e., stuffed) with a soft cushion material (not shown) prior to being covered with upholstery. External and internal back frame brackets 16 and 18 are affixed (by means of wood screws, or the like) at each of the opposite sides of the back rest 3. A pair of threaded machine bolts 20 and 22 are received through respective holes formed in the external and internal back frame brackets 16 and 18 at each side of the flip-up back rest 3. One of the machine bolts 20 functions as a pivot by which to enable the back rest 3 to rotate relative to the seat frame 8. The other one of the machine bolts 22 functions as a stop to limit the rotation of the flip-up back rest 3 from its closed position (of FIGS. 1 and 3) atop seat frame 8 to the open position (of FIGS. 2 and 4) standing upwardly from the seat frame 8.

An arcuate slot (only one of which 24 being shown) is formed in each of the opposing arm panels 5 and 6. An identical arcuate guide slot 26 is formed in each of a pair of arm panel brackets 28. The arm panel brackets 28 are affixed to respective arm panels 5 and 6 such that the arcuate slots 24 formed in the arm panels 5 and 6 are aligned with the guide slots 26 that are formed in the brackets 28. In the assembled relationship, each arm panel bracket 28 is disposed between one of the arm panels 5 and 6 and an external back frame bracket 16 at one side of the flip-up back rest 3.

Each of the threaded machine bolts 20 and 22 at each side of the flip-up back rest 3 passes through one of the internal back frame brackets 18, an external back frame bracket 16, a guide slot 26 of arm panel bracket 28, and the slot 24 in one of the arm panels 5 or 6. The bolts 20 and 22 are coupled to respective threaded nuts 30 to pivotally connect the back rest 3 between the arm panels 5 and 6.

Accordingly, and as is best shown in FIGS. 3 and 4, each of the machine bolts 20 and 22 is adapted to simultaneously ride through the oppositely aligned slots 24 and 26 formed in each of the arm panels 5 and 6 and the opposing arm panel bracket 28 as the flip-up back rest 3 is rotated from the closed position to the open position. More particularly, the forward-most bolts 20 function as sliding pivot pins that enable the back rest 3 to rotate relative to the seat frame 8 from the horizontal closed position lying atop the back rest 3 at which to establish the ottoman 1 (of FIGS. 1 and 3) to the vertical open position standing upwardly from the seat frame 8 at which to establish the chair 1-1 (of FIGS. 2 and 4). In this same regard, the rearward-most bolts 22 function as stops which slide to the ends of the slots 24 and 26 and thereby limit the upward travel of the flip-up back rest 3 when the back rest is rotated off the seat frame 8 to the open and vertical upstanding position at which to establish the chair 1-1. A pair of machine bolts 20 and 22 is preferable to provide structural reinforcement and stability as the back rest 3 is rotated between the closed and open positions.

By virtue of the folding ottoman 1 herein disclosed, a user has the ability to convert a compact ottoman into a comfortable chair having a seat and back rest on an as-needed basis in a confined living space. Moreover, the ability to convert the chair into an ottoman enables the valuable conservation of space during shipment and storage.

The invention claimed is:

1. A folding ottoman which is convertible to a chair, comprising:

a pair of arm panels spaced from one another, each of said pair of arm panels having a slot formed therein;

a frame extending between said pair of arm panels;

a pull-out drawer having a storage space at the interior thereof in which articles can be stored, said pull-out drawer located below said frame and between said pair of arm panels;

a flip-up back rest pivotally connected to said arm panels so as to rotate from a closed horizontal position lying atop said frame at which to establish said ottoman to an open vertical position standing upwardly from said frame at which to establish said chair; and first and second pairs of pivot pins extending between said flip-up back rest and each of said pair of arm panels for receipt through respective ones of said slots formed in said arm panels, said first and second pairs of pivot pins riding through said slots as said flip-up back rest is rotated between the closed horizontal position atop said frame to the open vertical position standing upwardly from said frame, one pivot pin from each of said first and second pairs of pivot pins riding to an end of said slots at which a stop is created to limit the rotation of said flip-up back rest to the open vertical position standing upwardly from said frame.

2. The folding ottoman recited in claim 1, also comprising an arm panel bracket connected between one of said pair of arm panels and said flip-up back rest, said arm panel bracket having a guide slot formed therein and aligned with the slot formed in said arm panel for receiving one of said first and second pairs of pivot pins.

3. The folding ottoman recited in claim 1, wherein said flip-up back rest is a hollow shell adapted to be filled with a cushion material to support a back of a user thereagainst when said back rest is rotated to the open vertical position standing upwardly from said frame at which to establish said chair.

4. The folding ottoman recited in claim 1, wherein said pull-out drawer is slidably connected to said pair of arm panels so as to be slidable outwardly relative to said frame to permit access to the storage space at the interior of said pull-out drawer in response to a pulling force applied thereto.

5. The folding ottoman recited in claim 1, wherein said frame is hollow so as to be adapted to be filled with a cushion material to support weight of a user when said back rest is rotated to the open vertical position standing upwardly from said frame at which to establish said chair.

6. A folding ottoman which is convertible to a chair, comprising:

a pair of arm panels spaced from one another;

a seat extending between said pair of arm panels to support weight of a user seated thereon;

a hollow flip-up back rest pivotally connected to said arm panels so as to rotate from a closed horizontal position lying atop said seat at which to establish said ottoman to an open vertical position standing upwardly from said seat at which to establish said chair; and an arm panel bracket connected between one of said pair of arm panels and said flip-up back rest, said arm panel bracket having a guide slot formed therein and at least one pivot pin to pivotally connect said flip-up back rest to the said one of said pair of arm panels, said pivot pin received by and riding through said guide slot when said flip-up back rest rotates between said closed horizontal position and said open vertical position, said hollow flip-up back rest filled with a cushion material to support the back of the user when said back rest is rotated to said open position at which to establish said seat and to support the weight of the user seated on said flip-up back rest when said back rest is rotated to said closed position at which to establish said ottoman.

7. The folding ottoman recited in claim 6, also comprising a storage space located below said seat in which articles can be stored.

8. The folding ottoman recited in claim 7, also comprising a pull-out drawer located below said seat and having said storage space at the interior thereof.

9. The folding ottoman recited in claim 8, wherein said pull-out drawer is slidably connected to said pair of arm panels so as to be slidable outwardly relative to said seat to permit access to the storage space at the interior of said pull-out drawer in response to a pulling force applied thereto.

10. A folding ottoman which is convertible to a chair, comprising:

a pair of arm panels spaced from one another;

a frame extending between said pair of arm panels;

a flip-up back rest pivotally connected to said arm panels so as to rotate from a closed horizontal position lying atop said frame at which to establish said ottoman to an open vertical position standing upwardly from said frame at which to establish said chair;

first and second pivot pins to pivotally connect said flip-up back rest to one of said pair of arm panels; and an arm panel bracket connected between the said one of said pair of arm panels and said flip-up back rest, said arm panel bracket having a guide slot formed therein for receiving said first and second pivot pins, said first pivot pin riding through the guide slot of said arm panel bracket to engage one end of said guide slot to create a first stop when said flip-up back rest is rotated to the closed horizontal position lying atop said frame, and said second pivot pin riding through said guide slot to engage the opposite end thereof to create a second stop when said flip-up back rest is rotated to the open vertical position standing upwardly from said frame.

11. A folding ottoman which is convertible to a chair, comprising:

a pair of arm panels spaced from one another;

a frame extending between said pair of arm panels, each of said pair of arm panels having a guide slot formed therein;

a flip-up back rest pivotally connected to said arm panels so as to rotate from a closed horizontal position lying atop said frame at which to establish said ottoman to an open vertical position standing upwardly from said frame at which to establish said chair; and first and second pivot pins to pivotally connect said flip-up back rest to a first of said pair of arm panels at said guide slot thereof, said first pivot pin riding through the guide slot of said first arm panel to engage one end of said guide slot to create a first stop when said flip-up back rest is rotated to the closed horizontal position lying atop said frame, and said second pivot pin riding through said guide slot to engage the opposite end thereof to create a second stop when said flip-up back rest is rotated to the open vertical position standing upwardly from said frame.

* * * * *